US010759040B2

(12) United States Patent
Switlicki

(10) Patent No.: US 10,759,040 B2
(45) Date of Patent: Sep. 1, 2020

(54) BAR SUPPORT FOR POSITIONING A PORTION OF A SHEET MATERIAL DURING SAWING

(71) Applicant: Michael A. Switlicki, Troy, MI (US)

(72) Inventor: Michael A. Switlicki, Troy, MI (US)

( * ) Notice: Subject to any disclaimer, the term of this patent is extended or adjusted under 35 U.S.C. 154(b) by 191 days.

(21) Appl. No.: 16/174,467

(22) Filed: Oct. 30, 2018

(65) Prior Publication Data

US 2019/0275661 A1 Sep. 12, 2019

Related U.S. Application Data

(60) Provisional application No. 62/640,015, filed on Mar. 8, 2018.

(51) Int. Cl.
*B25H 1/00* (2006.01)
*B27B 9/00* (2006.01)

(52) U.S. Cl.
CPC . *B25H 1/00* (2013.01); *B27B 9/00* (2013.01)

(58) Field of Classification Search
CPC ..... B23Q 9/0042; B23Q 9/0019; B23Q 1/01; B23Q 1/015; B23Q 1/0021; B23Q 1/0042; B23Q 1/0064; B25H 1/00; B25H 1/04; B25H 1/08; B25H 1/0078; B27B 5/06; B25B 11/00; B25B 11/02; B25B 5/145
USPC ..... 269/289 R, 302.1, 309; 83/574, 466.1, 83/476.1, 468.3, 743, 745; 182/185.1, 182/186.7, 186.4, 183.1, 186.3; 125/13.1, 125/14
See application file for complete search history.

(56) References Cited

U.S. PATENT DOCUMENTS

| | | | | |
|---|---|---|---|---|
| 588,982 | A | 8/1897 | Gray | |
| 3,738,451 | A | 6/1973 | Kirkpatrick | |
| 4,152,834 | A | 5/1979 | Stansberry | |
| 4,770,274 | A | 9/1988 | Middleton | |
| 5,377,780 | A | 1/1995 | Dunaway | |
| 6,604,296 | B2 * | 8/2003 | Mastrobattista | B23Q 9/0042 30/293 |
| 7,198,042 | B2 * | 4/2007 | Harris | B23Q 9/0042 125/13.01 |
| 7,644,899 | B2 | 1/2010 | Fasanella | |
| 2006/0124396 | A1 | 6/2006 | DeOrnellas | |
| 2009/0183948 | A1 | 7/2009 | Sciorrotta, Jr. | |

* cited by examiner

*Primary Examiner* — Tyrone V Hall, Jr.
*Assistant Examiner* — Makena S Markman
(74) *Attorney, Agent, or Firm* — Dinsmore & Shohl LLP

(57) ABSTRACT

An elongated bar support device, such as which can be used in singular fashion with an elongated beam or in paired fashion with a flattened sheet board material. An elongated body has a main extending section for supporting an underside of the board or beam. An intermediate section includes a multi-angled recess which extends below the support surface. A forward most portion of each bar support extends in angled or sloping fashion relative to a horizontal extending axis associated with the main extending section. A pair of support dowels extend in linearly spaced apart and inward (cross directed) fashion from the forward extending portion of each bar, to contact opposite surfaces of the plywood or sheet board at support locations forward of the intermediate crosswise recess and opposite a rearward extending direction of the main support section. Upon widthwise sectioning, the opposite surface supporting dowels retain the incised portion in position, without bending or buckling.

10 Claims, 4 Drawing Sheets

BAR SUPPORT FOR POSITIONING A PORTION OF A SHEET MATERIAL DURING SAWING

CROSS-REFERENCE TO RELATED APPLICATIONS

The present application claims the priority of U.S. Ser. No. 62/640,015 filed Mar. 8, 2018.

FIELD OF THE INVENTION

The present invention relates generally to a bar support device for securing and supporting any of a plywood or sheet board material during an incising. More specifically, the present invention discloses an elongated support bar or bracket, such as which can be utilized in singular fashion when supporting a rectangular cross sectional beam (such as a 2"×4" board) or in paired fashion for supporting opposite edges of the horizontally supported sheet board material (e.g. a 4'×8' wood or particle board sheet). Upon widthwise sectioning, the incised portion is retained in position, without bending or buckling, and without the saw operator or an assistant being required to physically hold the sectioned area of board or sheet material, therefore preventing binding of the saw within the incising zone and preventing damage to the material, operator or equipment.

BACKGROUND OF THE INVENTION

The prior art is documented with examples of saw horse or work support assemblies, such as which can be used with a plywood or sheet board material during incising. A first example of this is depicted in U.S. 2009/0183948, to Sciorrotta, Jr., which teaches an adjustable leg, collapsible saw horse in which roller style attachments are secured to multi-jointed, pivotable arms that in turn are slidably related to the sawhorse support structure. The roller-style attachments facilitate upload, support, cut and offload of a large workpiece, such as a 4'×8' sheet of plywood, by a single person, with the roller-style attachments hanging unobstructively below the sawhorse support surface when not in use.

Another example of a saw horse construction is shown in U.S. Pat. No. 4,152,834, to Stansberry, which teaches a horizontal member having a pair of supporting legs provided at each end, these constructed out of sheet metal formed to a general channel shape in cross-section. The legs are pinned to the cross member so that they are folded up to lay flat against the horizontal member, or are erected to extend downward and outwardly below it, with a spring set locking means to fix and keep the legs erect or allow them to be folded up, as and when desired.

Finally, U.S. Pat. No. 4,770,274, to Middleto, teaches a saw horse bracket and resulting saw horse which may be easily assembled and disassembled through the use of a pair of mounting brackets, these each fixedly joined together and including a channel-shaped body which defines a cavity therein for receiving the legs of the saw horse. Connecting flanges extend forwardly from each bracket member and overlap with the connecting flanges of the other bracket member, with a fastening arrangement which fixedly joins the overlapping connecting flanges, and a mounting flange which is received within openings in the cross beam.

SUMMARY OF THE INVENTION

The present invention discloses a novel elongated bar support device, such as which can be used in singular fashion with an elongated beam (e.g. 2"×4") or in paired fashion with a flattened sheet board material (e.g. 4'×8'). The present invention differs from prior art devices which are often incorporated into a saw horse, in that the present support attachment allows the plywood or sheet board material to be laid out horizontally on any table top support surface or the like, which can also include a flat work surface as well as a pair of spaced apart conventional saw horses.

The elongated bar supports each include an elongated body with a main and linearly extending support section for supporting an underside of the board or beam. An intermediate section of each bar support further includes a multi-angled recess (such forming a "V" or "U" shape), such as which extends below the horizontal support surface of the beam or board. A forward most portion of each bar support extends in any of an angled or sloping fashion relative to a horizontal extending axis associated with the main support section.

A pair of support dowels extend in linearly spaced apart and inward (cross directed) fashion from the forward extending portion of each bar, the support dowels are both linearly and vertically offset so as to contact opposite (upper and lower facing) surfaces of the plywood or sheet board at support locations forward of the intermediate crosswise recess and opposite a rearward extending direction of the main support section.

In operation, the crosswise extending recessed location accommodates a widthwise travel direction of an incising blade, such as associated with a portable rotary hand saw. Upon widthwise sectioning, opposite surface supporting dowels retain the incised portion in position, without bending or buckling, and without the saw operator or an assistant being required to physically hold the sectioned area of board or sheet material, therefore preventing binding of the saw within the incising zone and preventing damage to the material, operator or equipment.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to FIGS. 1-5, the present invention discloses an elongated bar support device, see at shown in paired and mirrored fashion generally at 10 and 10', such as which can be used in singular fashion with an elongated beam (not shown but which can include such as a 2"×4" cross section) or, alternatively, in paired fashion (as shown) with a flattened sheet board material (e.g. such as a 4'×8' sheet board material which is depicted at 2). As further shown in each of FIGS. 1, 3 and 5, and with the support bars 10 and 10' in position along opposite extending sides of the sheet, an incised section 2' of the sheet is further defined which is separated from a main sheet section (again at 2) by a crosswise incising location (further defined by dash line at 4 in FIG. 5).

As will be further established through the following description, and upon a widthwise travel direction of an incising blade, such as associated with a portable rotary hand saw 6 (FIG. 5), the elongated support bars retain the incised portion 2' of the sheet board or beam in position, without bending or buckling, and without the saw operator or an assistant (not shown) being required to physically hold the sectioned area of board or sheet material. Accordingly, the present invention prevents binding of the saw 6 within the incising zone 4 and further prevents damage to the material, operator or equipment.

With reference to the illustrations, the elongated bar supports can again be provided individually for supporting a smaller cross sectional dimensioned beam (not shown) or can be provided in paired and mirrored designed fashion, such as again shown at 10 and 10', positioned in extending fashion against opposite length extending sides of the flattened sheet board material (again at 2). As further shown, each bar exhibits a square or rectangular cross section to provide abutting support upon a flattened main support surface (see at 8 in FIGS. 1 and 3) and to prevent the support bars 10/10' from rotating displacing in a crosswise direction relative to the extending side edges (see at 3 and 5) of the sheet board 2.

Figure 2:
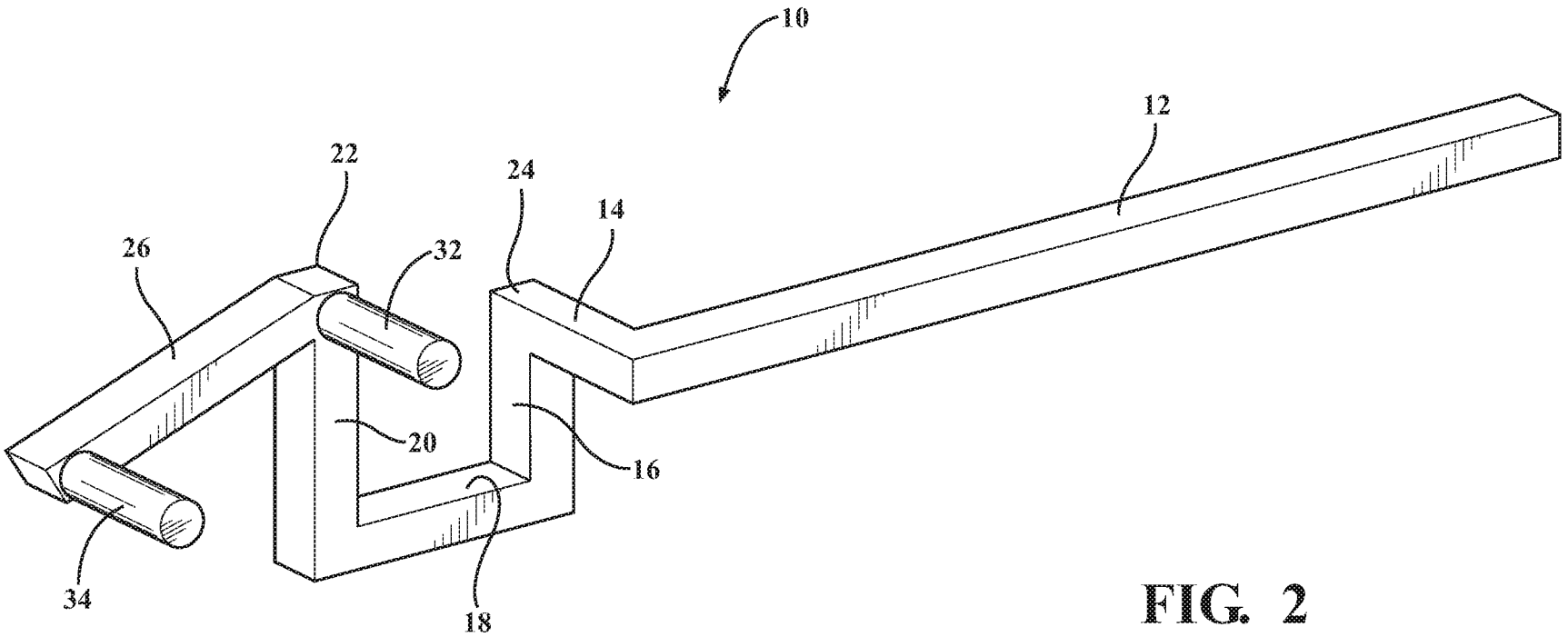
FIG. 2 is a perspective view of a selected support bar and illustrating each of the rear/main extending support section, intermediate recessed/incising zone defined section, and forward most angled/sloped extending section with crosswise extending dowels support pins.

With further reference to selected elongated support bar 10 depicted in FIG. 2, each support bar can be constructed of a durable material not limited to a steel, aluminum, wood or wood composite, or polymeric composite material.

Each support bar, again referring by example to bar 10 in FIG. 2, includes an elongated body with a main and linearly extending support section 12 for supporting an underside surface (at 7 in FIGS. 1 and 3) of the board or beam in a horizontal planar direction. An intermediate section of each bar support further includes a multi-angled recess (such forming a "V" or "U" shape), such as which extends below the horizontal support surface of the beam (again at 12) or board (again at 2).

In the illustration of FIG. 2, the intermediate section includes a series of bends including a first cross directed and inward bend 14 extending from a forward interconnecting end of the main section 12, with a succeeding series of downwardly vertical 16, horizontal base 18 and reverse upward vertical 20 bends defining a general "U" shape in the illustrated embodiment. An end surface 22 of the upwardly extending bend 20 as shown can be at an elevation higher than a surface 24 at the juncture of the inward bend 14 with the downwardly extending vertical bend 16.

Figure 3:
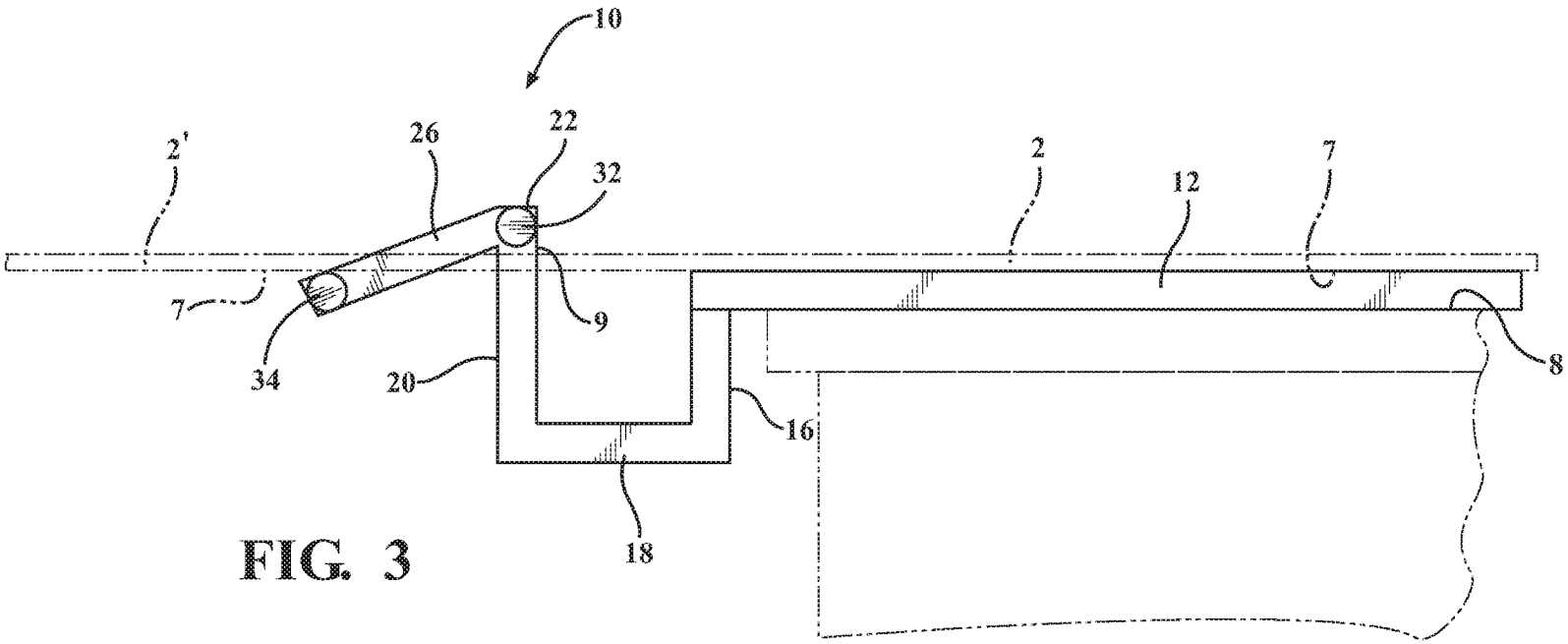
FIG. 3 is a cutaway plan environmental view taken from FIG. 1 and illustrating a selected support bar with crosswise extending dowels positioned against upper and lower surface locations of the sheet or plywood.
Figure 4:
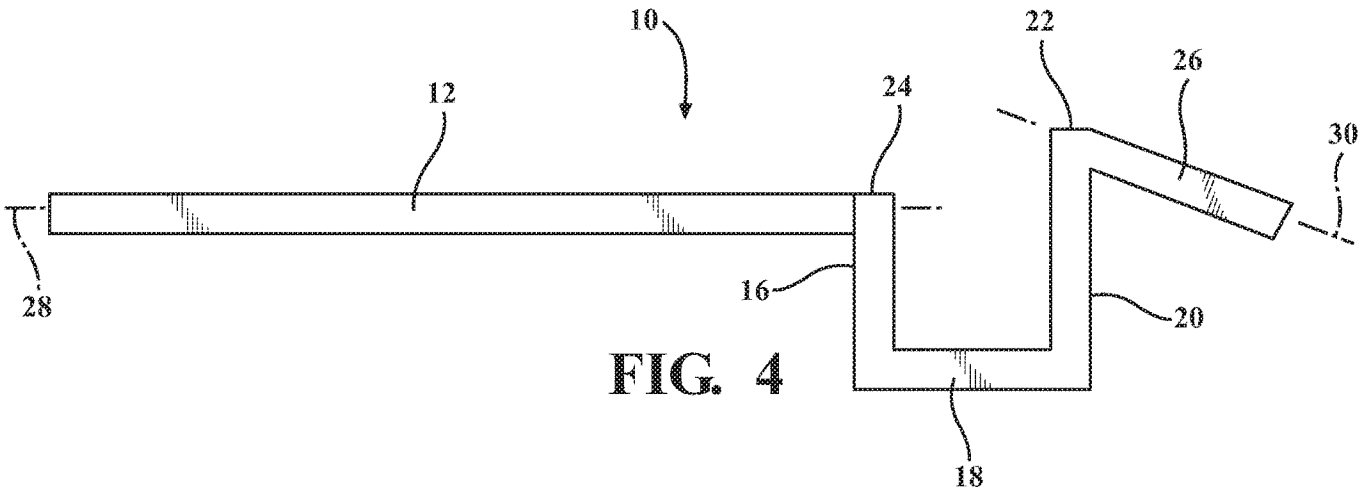
FIG. 4 is a 180° rotated plan view of the support bar from FIG. 3 and illustrating the horizontal axis of the main rear support section and angled axis of the forward extending section.

A forward most portion of each bar includes a final support section 26 extends in any of an angled (as shown) or optionally sloping fashion relative to a horizontal extending axis (see at 28 in FIG. 3) associated with the main support section 12. In the illustration of FIG. 3, the forward section 26 is linear and defines an angled axis of direction, further at 30, which is offset from the main extending axis 28 corresponding with the horizontal support surface provided for the sheet material 2.

A pair of support dowels 32 and 34 extend in linearly spaced apart and inward (cross directed) fashion from the forward extending angled portion 26 of each bar 10, the support dowels as shown being both linearly and vertically offset so as to contact the opposite upper surface (at 9) and lower facing surface (again at 7) of the plywood or sheet board, this at support locations forward of the intermediate crosswise recess defined by the intermediate portion (see again incision line 4) and opposite a rearward extending direction of the main support section 12 of the elongated bar support.

Figure 1:
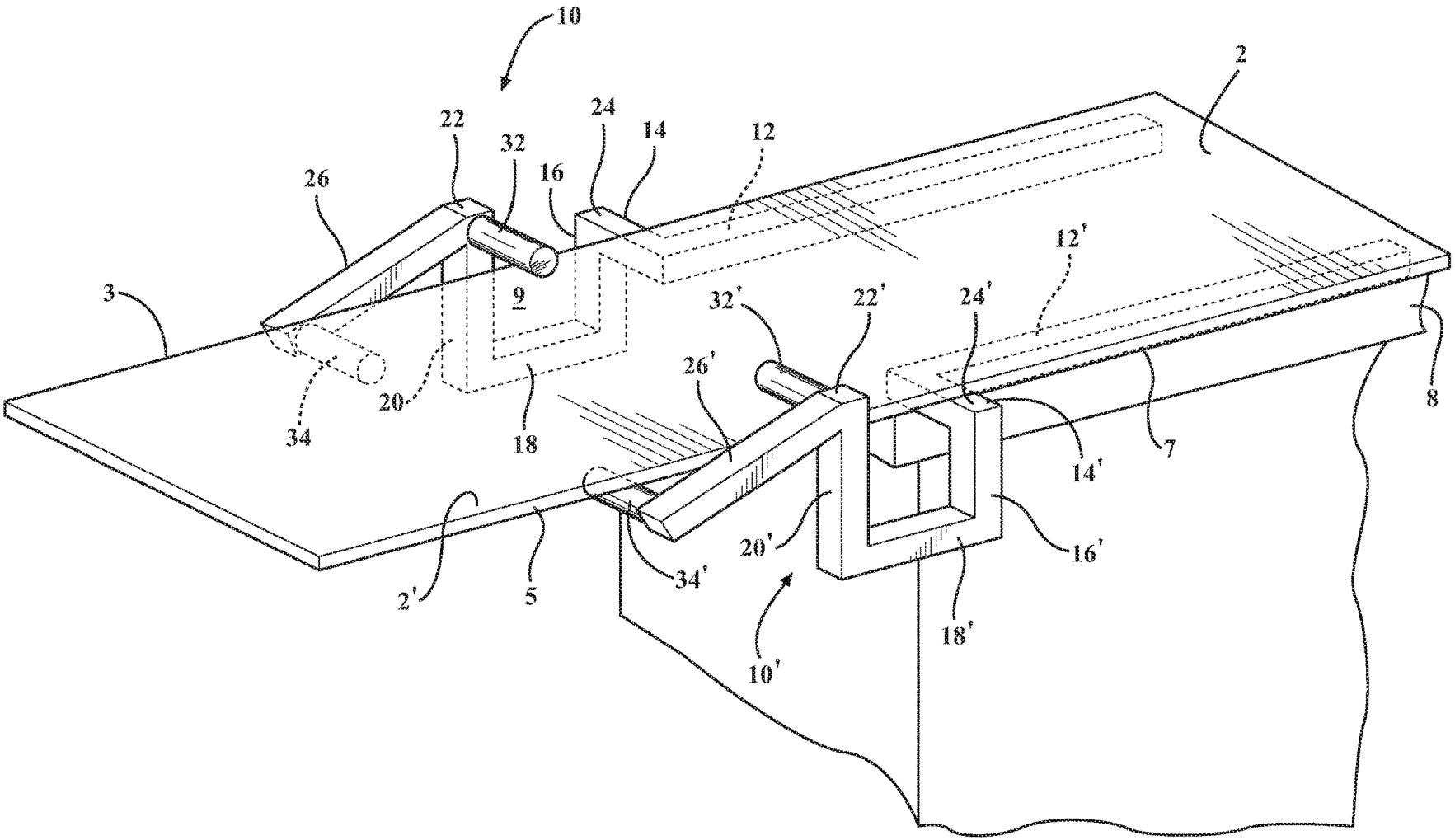
FIG. 1 is an environmental illustration of a pair of elongated support bars according to one embodiment of the present invention, these depicted in mirrored configuration and for supporting opposite length extending edges an elongated sheet board material prior to being sectioned.
Figure 5:
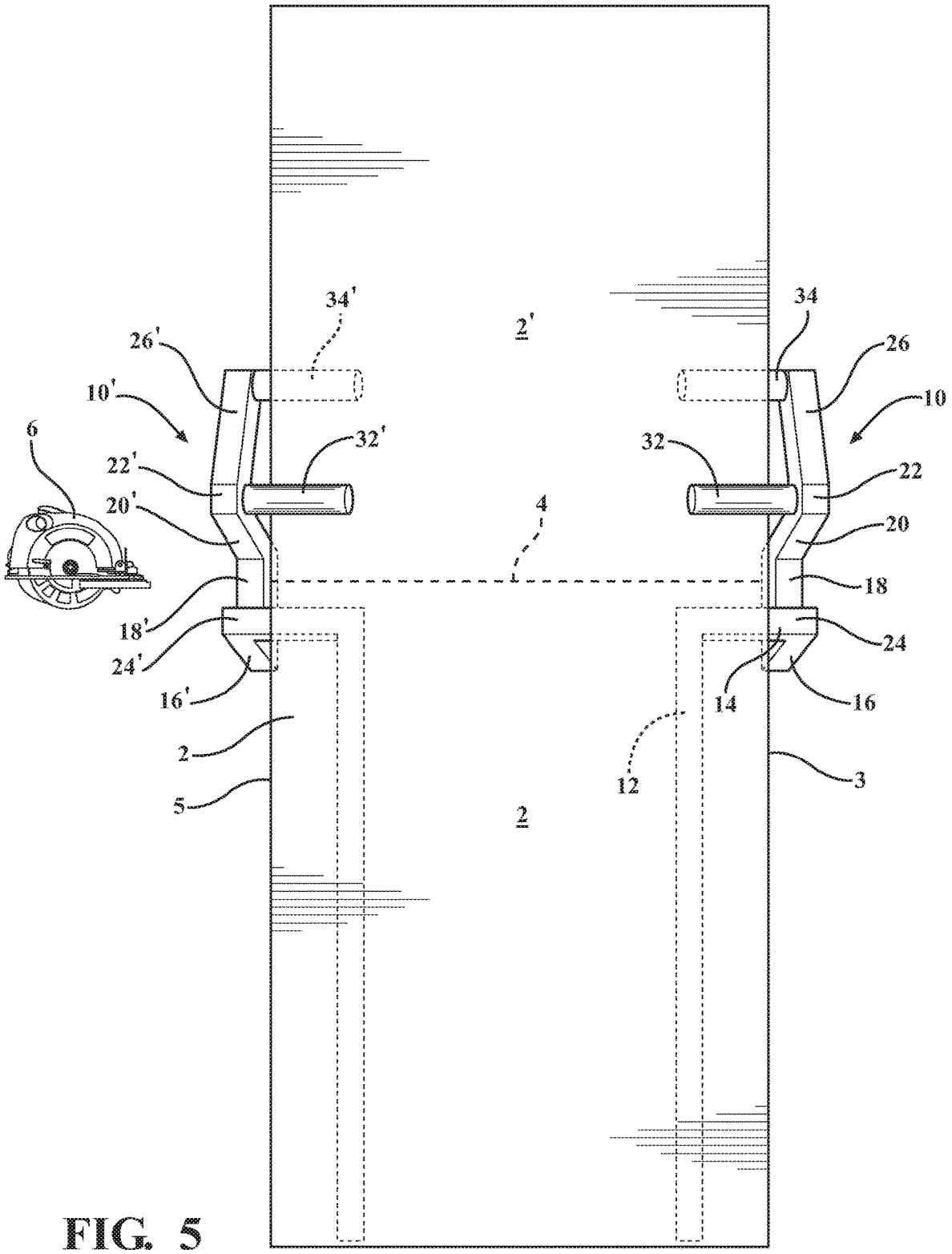
FIG. 5 is an overhead environmental view of the arrangement of FIG. 1.

With reference to FIGS. 1 and 5, the mirrored elongated support bar 10' is positional along edge 5 of the sheet board material opposite edge 3 associated with the support bar 10. Mirrored support bar 10', such as which is again used in paired fashion with the afore-described bar 10 in the instance of supporting opposite edges of a widened (e.g. 4'×8') sheet board, exhibits a mirroring arrangement of elements, these again including each of a main and linearly extending support section 12' for supporting an underside surface (again at 7 in FIGS. 1 and 3) of the board or beam. Intermediate section of each bar support again includes a multi-angled recess (such forming a "V" or "U" shape and is depicted as a series of bends including a first cross directed and inward bend 14' extending from a forward interconnecting end of the main section 12', with a succeeding series of downwardly vertical 16', horizontal base 18' and upward vertical 20' bends defining a general "U" shape in the illustrated embodiment. An end surface 22' of the reversing upwardly extending bend 20' as shown can be at an elevation higher than a surface 24' at the juncture of the inward bend 14' with the downwardly extending vertical bend 16'.

As with bar 10 as previously described, a forward most portion of each mirror arranged bar 10' includes a final support section 26' which again extends in any of an angled (as shown) or optionally sloping fashion relative to a horizontal extending axis (again as previously described at 28 in FIG. 3 for bar 10) associated with the main support section 12'. The forward section 26' is again depicted in linear extending fashion and defines an angled axis of direction, (also as previously shown at 30 for bar 10), which is offset from the main extending axis 28' corresponding with the horizontal support surface provided for the sheet material 2.

Finally, the mirrored support bar 10' includes a pair of support dowels 32' and 34' which extend in linearly spaced apart and inward (cross directed) fashion from the forward extending angled portion 26' of each bar 10'. The support dowels 32'/34' are again shown being both linearly and vertically offset so as to contact the opposite upper surface (at 9) and lower facing surface (again at 7) of the plywood or sheet board, this at support locations forward of the intermediate crosswise recess defined by the intermediate portion (see again incision line 4) and opposite a rearward extending direction of the main support section 12 of the elongated bar support.

In operation, the crosswise extending recessed location accommodates a widthwise travel direction of an incising blade, such as associated with a portable rotary hand saw. Upon widthwise sectioning, opposite surface supporting dowels retain the incised portion in position, without bending or buckling, and without the saw operator or an assistant being required to physically hold the sectioned area of board or sheet material, therefore preventing binding of the saw within the incising zone and preventing damage to the material, operator or equipment.

Additional variants include utilizing the elongated bar for cutting other sheet board materials including without limitation drywall. The elongated support tool can also be used in a ground supported configuration to elevate the elongated member or sheet board material. Beyond that shown, any plurality of the elongated support tools can also be arranged along any of parallel or non-parallel (e.g. crosswise extending) sides of the sheet board article being supported and in order to support the material during the making of odd cuts/incisions which may not be straight across the material or when cutting holes for electrical outlets. This also allows for the user to pre-score drywall sheets in one application without the cut breaking or move the cut to the unsupported side to instantly break the cut on the drywall sheet.

Having described my invention, other and additional preferred embodiments will become apparent to those skilled in the art to which it pertains, and without deviating from the scope of the appended claims. This can include the elongated support bar or bars exhibiting any other shape or configuration for adequately supporting and retaining in position a section of a plywood or sheet board material during crosswise sectioning, and according to the objectives described herein. Other variants can include the main extending rear sections (12 and 12') being reconfigured to support against the upper surface 9 of the board material, with the arrangement of the dowels (32/32' and 34/34') being reversed relative to the upper and lower surfaces of the board material.

I claim:

1. An elongated support for use with a board material during an incising operation, said support comprising:

a main extending section adapted to be supported upon a planar surface and in turn adapted to supporting an underside surface of the board material arrayed in a horizontal direction;

an intermediate section extending from said main section, said intermediate section exhibiting multiple angled bends to define a recess extending below said main extending section; and a forward-most section extending at an angle relative to said main section, a pair of support dowels extending from said forward-most section in linearly spaced apart and inward directions relative to a side extending edge of the board material;

said support dowels adapting to contact both said underside and opposite upper side surfaces of the board material to retain in position a portion of the board material incised from a further portion of the board material supported upon said main extending section.

2. The elongated support of claim 1, said intermediate section further comprising a succeeding series of inward, downward, horizontal and reverse upward bends defining a general "U" shape.

3. The elongated support of claim 2, further comprising an end surface of said upward bend being at an elevation higher than a surface at a juncture of said inward bend with said downward extending bend.

4. The elongated support of claim 1, further comprising at least said main extending section having a square cross sectional shape.

5. The elongated support of claim 1, said elongated support further comprising a rigid material including any of a steel, aluminum, wood, wood composite or plastic composite.

6. A pair of elongated supports for use with a sheet board material during a width direction incising operation, said supports each having a mirroring configuration and adapted to contacting length extending edges of the board material, said supports each comprising:

a main extending section adapted to be supported upon a planar surface and in turn adapted to supporting an underside surface of the board material extending in a horizontal direction;

an intermediate section extending from said main section, said intermediate section exhibiting multiple angled bends to define a recess extending below said main extending section; and a forward-most section extending at an angle relative to said main section, a pair of support dowels extending from said forward-most section in linearly spaced apart and inward directions relative to a side extending edge of the board material;

said support dowels adapting to contact both said underside and opposite upper side surfaces of the board material to retain in position a portion of the board material incised from a further portion of the board material supported upon said main extending section.

7. The pair of elongated supports of claim 6, said intermediate section of each further comprising a succeeding series of inward, downward, horizontal and reverse upward bends defining a general "U" shape.

8. The pair of elongated supports of claim 7, each further comprising an end surface of said upward bend being at an elevation higher than a surface at a juncture of said inward bend with said downward extending bend.

9. The pair of elongated supports of claim 6, each further comprising at least said main extending section having a square cross sectional shape.

10. The pair of elongated supports of claim 6, each further comprising a rigid material including any of a steel, aluminum, wood, wood composite or plastic composite.

* * * * *